US008360162B2

(12) United States Patent
Lelic et al.

(10) Patent No.: US 8,360,162 B2
(45) Date of Patent: Jan. 29, 2013

(54) HYBRID INERT GAS FIRE SUPPRESSION SYSTEM

(75) Inventors: Muhidin A. Lelic, Manchester, CT (US); Giuliano Amantini, Glastonbury, CT (US); Robert G. Dunster, Slough (GB); Rob J. Lade, Marlow (GB); Ravi K. Madabhushi, Longmeadow, MA (US); Marios C. Soteriou, Middletown, CT (US)

(73) Assignee: UTC Fire & Security Corporation, Farmington, CT (US)

( * ) Notice: Subject to any disclaimer, the term of this patent is extended or adjusted under 35 U.S.C. 154(b) by 102 days.

(21) Appl. No.: 12/678,883

(22) PCT Filed: Sep. 24, 2007

(86) PCT No.: PCT/US2007/020590

§ 371 (c)(1), (2), (4) Date: Jun. 30, 2010

(87) PCT Pub. No.: WO2009/041935

PCT Pub. Date: Apr. 2, 2009

(65) Prior Publication Data

US 2010/0294518 A1 Nov. 25, 2010

(51) Int. Cl.
*A62C 35/00* (2006.01)
*A62C 37/08* (2006.01)

(52) U.S. Cl. ..... 169/16; 169/5; 169/9; 169/11; 169/14; 169/37

(58) Field of Classification Search ..... 169/5, 9, 169/11, 14, 15, 16, 37, 44
See application file for complete search history.

(56) References Cited

U.S. PATENT DOCUMENTS

| | | | | |
|---|---|---|---|---|
| 4,067,392 | A | 1/1978 | Rich | |
| 5,845,714 | A * | 12/1998 | Sundholm | 169/46 |
| 6,173,790 | B1 * | 1/2001 | Russwurm et al. | 169/44 |
| 6,390,203 | B1 * | 5/2002 | Borisov et al. | 169/62 |
| 6,739,400 | B2 * | 5/2004 | Lessi et al. | 169/46 |

(Continued)

FOREIGN PATENT DOCUMENTS

| | | |
|---|---|---|
| CN | 1426820 | 7/2003 |
| JP | 2001157723 A | 6/2001 |

OTHER PUBLICATIONS

International Preliminary Report on Patentability mailed Jul. 20, 2010 (3 pgs.).
International Search Report and Written Opinion mailed Jul. 25, 2008 (9 pgs.).

*Primary Examiner* — Len Tran
*Assistant Examiner* — Ryan Reis
(74) *Attorney, Agent, or Firm* — Cantor Colburn LLP

(57) ABSTRACT

A hybrid fire suppression system includes a supply of pressurized inert gas, a pipe network connected in inert gas flow communication to the inert gas supply, a first inert gas nozzle, a second inert gas nozzle, and a water storage cartridge having an interior volume defining a water reservoir storing a limited amount of water. The water reservoir communicates with the second inert gas spray nozzle. The first inert gas nozzle connects with the first terminus for introducing a flooding flow of inert gas only into a first protected space. The second inert gas nozzle connects with the second terminus for introducing a flooding flow of inert gas and the limited amount of water from the water reservoir into the second protected space.

9 Claims, 5 Drawing Sheets

U.S. PATENT DOCUMENTS

| | | | | |
|---|---|---|---|---|
| 6,763,894 | B2 | 7/2004 | Schoenrock et al. | |
| 6,871,802 | B2 | 3/2005 | Stilwell et al. | |
| 7,153,446 | B2 | 12/2006 | Grigg | |
| 2004/0163825 | A1 | 8/2004 | Dunster et al. | |
| 2005/0001065 | A1 | 1/2005 | Senecal | |
| 2005/0144949 | A1 | 7/2005 | Hamada et al. | |
| 2005/0173131 | A1 | 8/2005 | Dunster et al. | |
| 2006/0278410 | A1 * | 12/2006 | Reilly et al. | 169/37 |

* cited by examiner

HYBRID INERT GAS FIRE SUPPRESSION SYSTEM

CROSS REFERENCE TO RELATED APPLICATION

This application is related to International Patent Application Serial No. 12/678,875, entitled "INERT GAS FLOODING FIRE SUPPRESSION WITH WATER AUGMENTATION", filed with the United States Patent and Trademark Office on the same date as this application and subject to assignment to the common assignee of this application.

FIELD OF THE INVENTION

This invention relates generally to fire suppression systems. More particularly, this invention relates to a fire suppression system providing inert gas flooding fire suppression.

BACKGROUND OF THE INVENTION

Fire suppression fire systems are often installed in commercial buildings. Typically, those buildings are subdivided into multiple rooms. Commonly, conventional fire suppression systems are designed either as total flooding systems using an inert gas under pressure or localized streaming fire suppression systems using liquid suppressant under pressure. In total flooding systems, an inert gas is rapidly admitted into a room, commonly through a plurality of nozzles mounted in an array in the ceiling of the room, to fill the volume defined within the room. The inert gas may be nitrogen, carbon dioxide, argon, neon, helium or other chemically non-reactive gas, or mixtures of any two or more of these gases. For example, a mixture of 50% argon and 50% nitrogen is commonly used in inert gas fire suppression system. The inert gas not only removes heat from the fire, but also dilutes the oxygen content within the room to a level low enough that combustion can not be sustained. Typically, conventional inert gas systems are sized to reduce the oxygen content in the atmosphere within the environment of the protected area to a level below 12.5 percent within one minute. Consequently, a large number of high-pressure cylinders of inert gas, typically at a pressure between 200 to 300 bars must be provided to store the necessary volume of inert gas. A large centralized storage area must be dedicated for placement of the required inert gas storage cylinders.

Conventional streaming fire suppression systems spray a mist of liquid suppressant over a localized area beneath the spray cone of a distribution nozzle. Commonly, a number of distribution nozzles are arrayed over the space being protected and are supplied with liquid suppressant, for example water or a liquid chemical agent, from a centralized source. Typically, the liquid suppressant is fed under pressure and conveyed through a network of pipes to the various individual distribution nozzles. Generally, the distribution nozzles are designed to emit a mist of liquid suppressant having a droplet size in the range of between 5 and 60 micrometers. The mist may be produced simply by forcing the liquid suppressant through the openings of the nozzle or through atomization means incorporated in the nozzle.

U.S. Patent Application Publication No. US2005/073131A1 discloses a fire and explosion suppression system wherein high pressure water from a central storage tank is suspended in a flow of nitrogen gas or a mixture of nitrogen and argon gases and distributed to an array of a plurality of distribution nozzles and emitted as a mist of water droplets over a localized area. U.S. Patent Application Publication No. 2006/0278410 discloses a fire and explosion system wherein high pressure water from a central storage tank is passed through a network of pipes to a plurality of high velocity low pressure emitters wherein the water is atomized and discharged into a high pressure inert gas stream passing out of the emitter. U.S. Pat. No. 7,153,446, also published as Patent Application Publication No. US2005/0144949A1, discloses a fire and explosion suppression system wherein a liquid chemical agent fire suppressant under pressure from a central storage tank is suspended in a flow of inert gas and is distributed to an array of a plurality of distribution nozzles and emitted as a mist of liquid droplets over a localized area. A number of exemplary liquid chemical agents suitable for use as fire suppressants are also disclosed in U.S. Pat. No. 7,153,446.

A form of fire suppression system using a commercially available liquid chemical fire suppressant is commonly referred to as a clean agent gaseous fire suppression system because the chemical agent leaves no residue upon evaporation. Clean agent fire suppression systems are often installed in rooms or areas of buildings wherein equipment or goods are housed that could be damaged by water, powder or foam. In a system of this type, a chemical fire suppression agent that is stored in a tank or cylinder as a liquid under pressure is pushed by a gaseous propellant, typically nitrogen, argon or carbon dioxide, from a tank or cylinder of propellant arranged in series flow relationship with the tank or cylinder of chemical agent, through a network of pipes to and through a plurality of distribution nozzles arrayed across the ceiling area or walls of the space being protected. The chemical fire suppression agent is a volatile chemical that exists as a liquid when confined under pressure in a closed vessel, but rapidly vaporizes from its liquid state to a vapor state when sprayed via the distribution nozzles into the ambient atmosphere to form a gaseous mixture with the air within the space being protected which does not support combustion and extinguishes fires. The distribution nozzles function to atomize or otherwise break the liquid chemical fire suppressant into small droplets to facilitate evaporation. An example of a clean agent gaseous fire suppression system is disclosed in each of U.S. Pat. No. 6,763,894 and U.S. Patent Application Publication No. US2005/0001065A1.

SUMMARY OF THE INVENTION

A hybrid fire suppression system includes a supply of pressurized inert gas, a pipe network connected in inert gas flow communication to the inert gas supply, a first inert gas spray nozzle, a second inert gas spray nozzle, and a water storage cartridge having an interior volume defining a water reservoir storing a limited amount of water. The water reservoir is in water flow communication with the second inert gas spray nozzle. The pipe network has a first terminus associated with a first protected space and a second terminus associated with a second protected space. The first inert gas spray nozzle is connected in flow communication with the first terminus for introducing a flooding flow of inert gas only into the first protected space. The second inert gas spray nozzle is connected in flow communication with the second terminus for introducing a flooding flow of inert gas and the limited amount of water from the water reservoir into the second protected space. The water storage cartridge is disposed in close proximity to the second inert gas spray nozzle. The source of pressurized inert gas may be a source of a pressurized, chemically non-reactive gas selected from the group including nitrogen gas, carbon dioxide gas, helium gas, argon gas, neon gas, and mixtures of two or more thereof.

In an embodiment, the water storage cartridge has an elongated body extending along a longitudinal axis between an aft end and a forward end. The forward end of the water storage cartridge is disposed adjacent the second inert gas spray nozzle. A gas flow conduit establishes flow communication between the supply of pressurized inert gas and the interior volume of the water storage cartridge. A water conduit establishes flow communication between the interior volume of the water storage cartridge and the second inert gas spray nozzle.

In an embodiment, the hybrid fire suppression system further includes a third inert gas spray nozzle in flow communication with a third terminus of the pipe network and a source of pressurized water located remotely from the third inert gas spray nozzle. This water source holds a relatively large amount of water as compared to the limited amount of water stored in the water storage cartridge. A flow of inert gas having water from the remote water source entrained therein is introduced through the third inert gas spray nozzle into a third protected space.

A kit is also provided for retrofitting an inert gas spray nozzle of an inert gas fire suppression system wherein the inert gas spray nozzle is mounted to a terminal section of an inert gas supply pipe connected in flow communication with a source of pressurized inert gas. The kit includes a water storage cartridge having an interior volume defining a water reservoir storing a limited amount of water in close proximity to the inert gas spray nozzle, a gas flow conduit for establishing flow communication between the inert gas supply pipe and the interior volume of the water storage cartridge, and a water flow conduit for establishing flow communication between the interior volume of the water storage cartridge and the inert gas spray nozzle.

BRIEF DESCRIPTION OF THE DRAWINGS

For a further understanding of these and other objects of the invention, reference will be made to the following detailed description of the invention which is to be read in connection with the accompanying drawing, where.

DETAILED DESCRIPTION OF THE INVENTION

Figure 1:
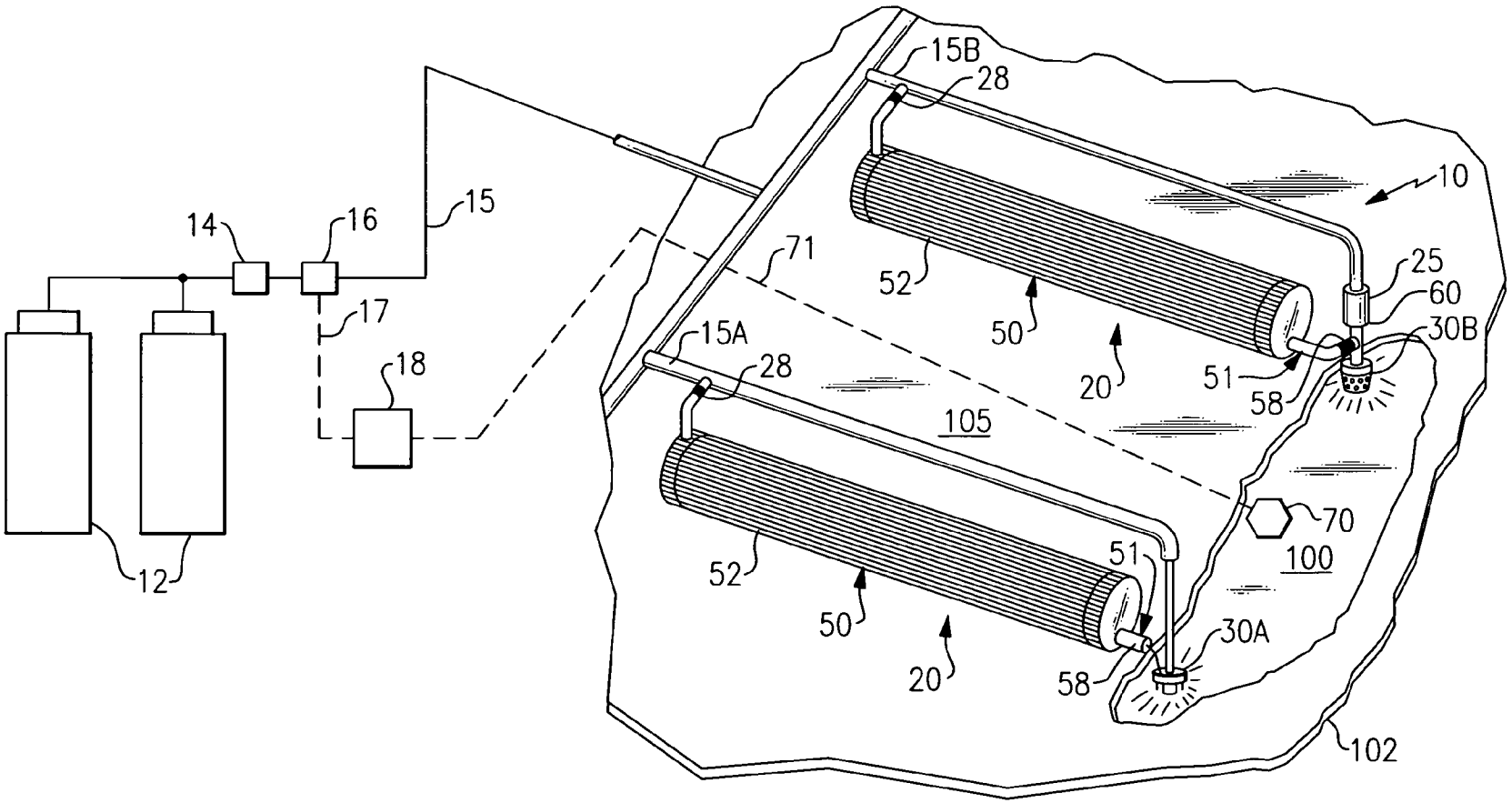
FIG. 1 is a depiction, partly is schematic and partly in perspective, of an exemplary embodiment of a fire suppression system in accord with the invention.

Referring now to FIGS. 1-5 in particular, there is depicted an exemplary embodiment of a hybrid inert gas fire suppression system 10 with water augmentation in accord with the invention. The system 10 includes one or more vessels 12 for storing an inert gas, i.e. a chemically non-reactive gas, such as nitrogen, argon, neon, helium, carbon dioxide or a mixture of two or more of these gases, and at least one spray nozzle assembly 20. Although two spray nozzle assemblies 20 are depicted in the exemplary embodiment of the system 10 illustrated in FIG. 1, it will be understood by those skilled in the art that the actual number of spray nozzle assemblies installed in any particular application will depend upon the volume and planar area of the protected space.

The inert gas storage vessels 12, each of which contains inert gas under pressure, typically at a pressure of 200 to 300 bars, are connected in flow communication with the spray nozzle assemblies 20 via a network of pipes 15, 15A and 15B. The pipes 15A and 15B, each of which branches off the main inert gas supply pipe 15 to feed inert gas to a respective one of the spray nozzle assemblies 20, may be referred to as a distribution pipe. As in conventional inert gas fire suppression systems, a pressure regulator 14 is disposed at the outlet of each of the inert gas vessels 12 for regulating the pressure leaving the inert gas vessels 12 to maintain an initial desired gas pressure within the inert gas flow line, typically up to 150 bars. A gas flow regulator 16 is disposed in pipe 15 downstream of the pressure regulator 14 for controlling the flow of inert gas through the pipe 15. Alternatively, the gas pressure regulator 14 and the gas flow regulator 16 may be collocated or even combined into a single valve or flow control device. A sensor 70 may be installed within the protected space 100 for detecting the existence of a fire within the protected space and for generating a fire detected signal. When a fire is detected, a fire detected signal 71 is transmitted from the sensor 70 to the system controller 18 which, in response to receipt of the fire detected signal 71, generates the demand signal 17 and transmits the demand signal 17 to the gas flow regulator 16 which, in response to receipt of the demand signal 17, opens to allow pressurized inert gas from the vessels 12 to flow through the pipes 15, 15A and 15B to the respective spray nozzle assemblies 20.

Each of the spray nozzle assemblies 20 includes a spray nozzle 30A or 30B mounted to the terminus of the terminal section of a respective one of the distribution pipes 15A and 15B that branch off of the inert gas supply pipe 15. The spray nozzle assemblies 20 are disposed above the ceiling 102 of the protected space 100 in the open space 105 that exists above the ceiling 102 and beneath the floor 104 of the next story thereabove or the roof of the structure, commonly referred to as the ceiling void. As in conventional practice, the terminal section of each of the branch pipes 15A and 15B extends generally vertically downward such that the spray nozzles 30A or 30B are disposed subadjacent the room-side, i.e. lower side, surface of the ceiling 102 extending over the protected space 100.

Each of the spray nozzle assemblies 20 of the hybrid inert gas flooding fire suppression system 10 of the invention further includes a reservoir of water 50 disposed in the ceiling void 105 in operative association with its respective one of the spray nozzles 30A and 30B. The reservoir of water 50 is stored at atmospheric pressure within the interior volume 55 of an elongated cartridge 52 having an aft end 54 and a forward end 56. As depicted in the exemplary embodiments shown in FIGS. 2 and 4, the water storage cartridge may be a cylinder. However, it is to be understood that the water storage cartridge could be in the form of a sphere, a rectangular parallelepiped, or any other suitable form. In the exemplary embodiments depicted in FIGS. 2 and 4, the cartridge 52 is disposed in association with the terminal section of each of the respective branch pipes 15A and 15B with the forward end 56 of the water storage cartridge 52 disposed in neighboring relationship with the spray nozzle 30A, 30B of the spray nozzle assembly 20. However, it is to be understood that the water storage cartridges 52 may be alternatively be located further upstream on the respective branch pipes 15A and 15B, that is more remotely from the respective spray nozzles 30A and 30B rather than being located in association with the terminal section of the branch pipes 15A and 15B.

Figure 2:
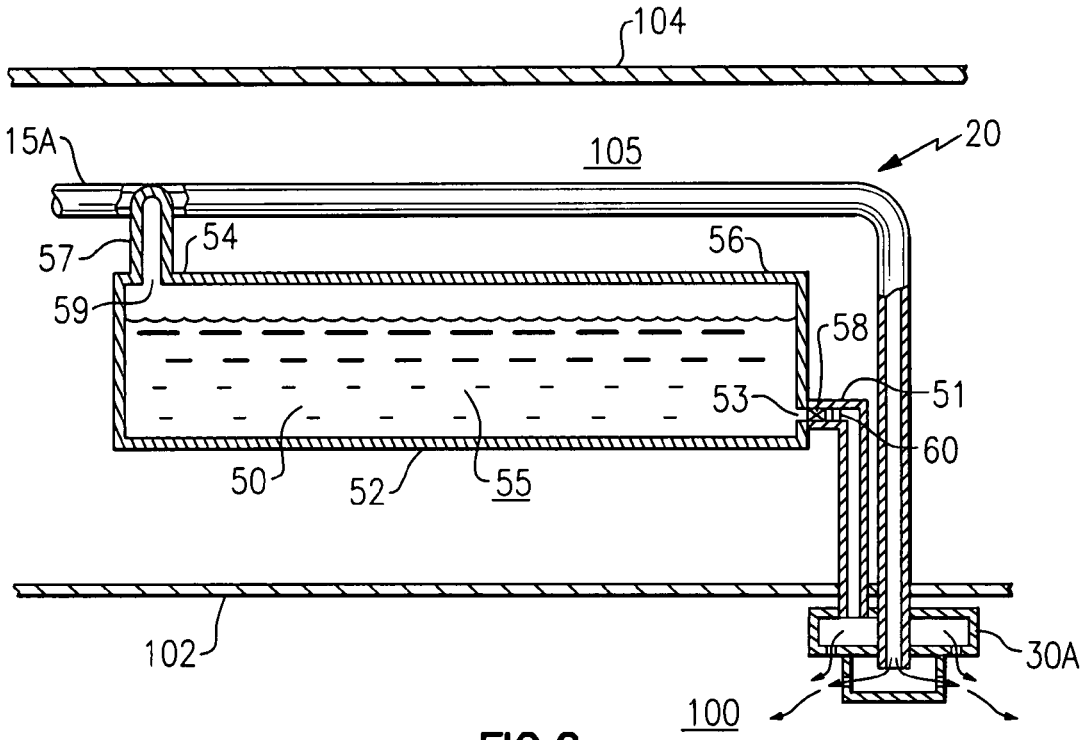
FIG. 2 is a sectioned side elevation view of the first embodiment of the nozzle assembly depicted in FIG. 1.
Figure 3:
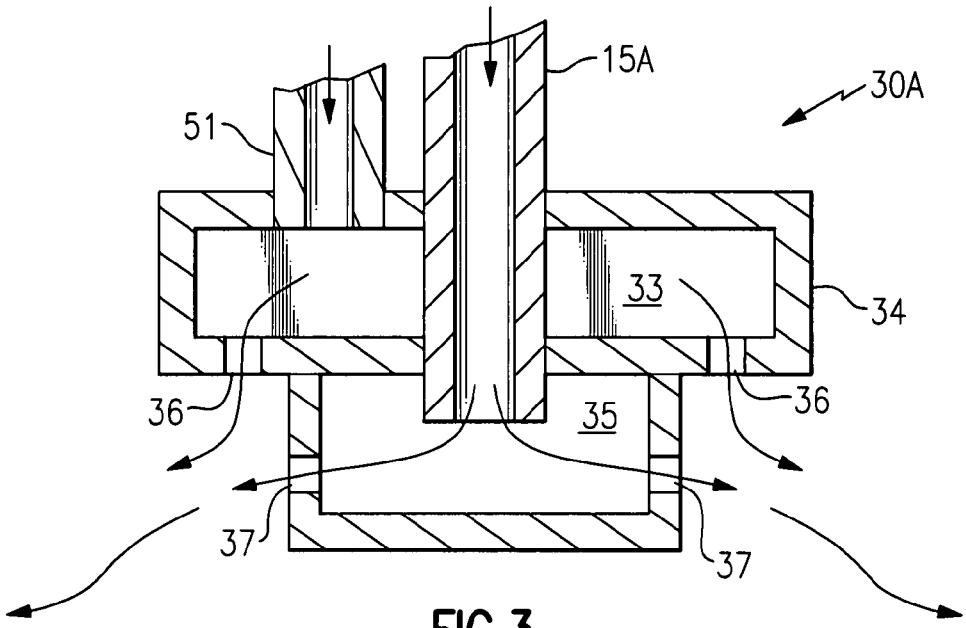
FIG. 3 is a sectioned elevation view of the spray nozzle shown in FIG. 2.

In the exemplary embodiment depicted in FIGS. 2 and 3, the spray nozzle 30A is a dual fluid atomizer having a body 34 defining an upper cavity 33 and a lower cavity 35. Water from the reservoir 50 passing through conduit 53 is introduced directly into the upper cavity 33 and inert gas is introduced directly into the lower cavity 35. A plurality of openings 37 through the lower side wall of the nozzle body 34 provide a plurality of circumferentially spaced outlets through which inert gas passes from the lower cavity 35. The inert gas enters the lower cavity 35 traveling generally vertically downward and turns to flow along the floor of the lower cavity and exit generally horizontally in the protected space 100 through the openings 37. Water exits from the upper cavity 33 generally vertically downward into the protected space through a plurality of openings 36 extending through the floor of the upper cavity at circumferentially spaced intervals located radially outward of the lower side wall of the nozzle body. As the water passes generally vertically downward, it is impacted by the generally horizontally directed inert gas causing the water to be atomized into a droplet mist and entrained in the inert gas stream to penetrate together with the inert gas into the ambient atmosphere within the protected space 100. It is to be understood that the dual fluid atomizer described herein is merely exemplary and that various other configurations of dual fluid atomizers may be used in connection with the fire suppression system and method of the invention.

Figure 4:
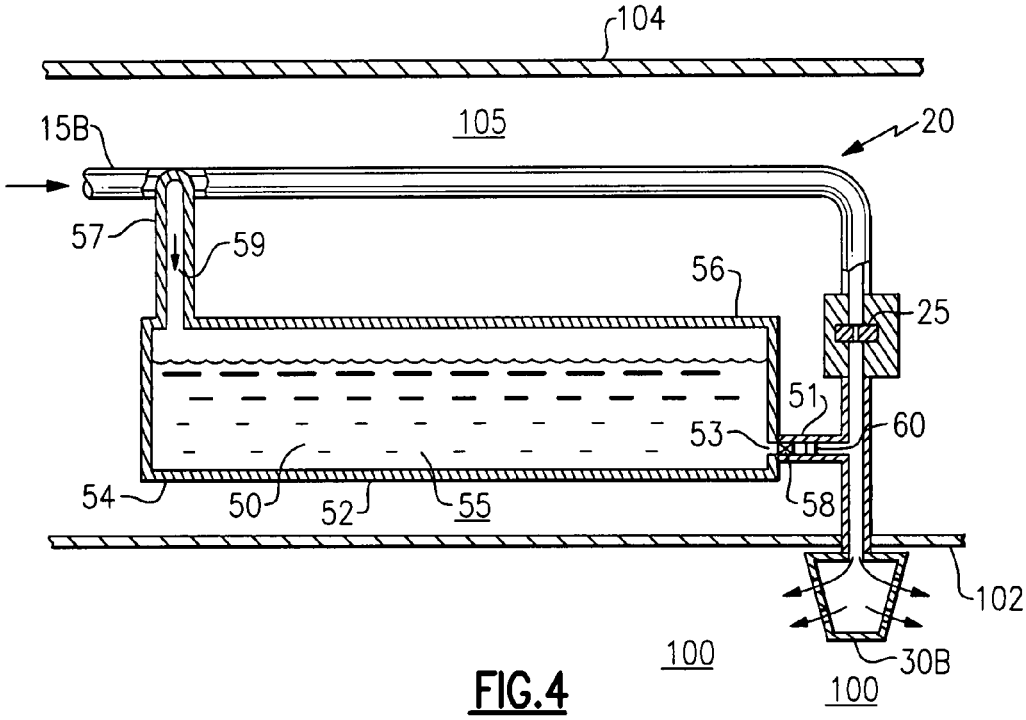
FIG. 4 is a sectioned side elevation view of the second embodiment of the nozzle assembly depicted in FIG. 1.
Figure 5:
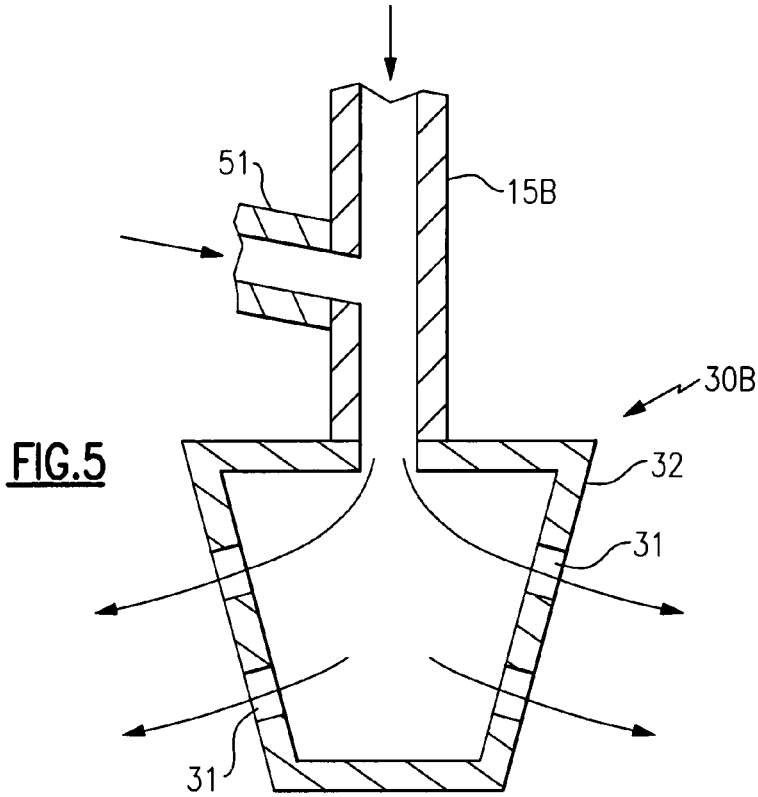
FIG. 5 is a sectioned elevation view of the spray nozzle shown in FIG. 4.

In the exemplary embodiment depicted in FIGS. 4 and 5, since the water from the reservoir 50 passing through conduit 51 is introduced into and mixes with the inert gas flow passing through the terminal portion of the distribution pipe 15B upstream of the spray nozzle 30B, the spray nozzle 30B may comprise any conventional distribution-type spray nozzle. For example, the spray nozzle 30B may have a plurality of openings 31, which in the depicted embodiment are arrayed in one or more rows at circumferentially spaced intervals about the body 32 of the spray nozzle. However, it is to be understood, that the openings 31, which may be holes or elongated slots or other shaped apertures, may be arrayed or otherwise disposed in other arrangements. In this type of spray nozzle, atomization of the water entrained in the inert gas flow occurs as a result of the force of the pressure drop encountered as the water/inert gas mix passes through the openings 31 and penetrates into the ambient atmosphere within the protected space 100.

A water conduit 51 establishes water flow communication between the interior volume 55 of the water storage cartridge 52 through an outlet 53 at the lower portion of the forward end 56 of the cartridge 52 and the respective spray nozzle 30A, 30B associated with the cartridge 52. In the exemplary embodiment depicted in FIGS. 2 and 3, the water conduit 51 opens into the upper cavity of the spray nozzle 30A. In the exemplary embodiment depicted in FIGS. 4 and 5, the conduit 51 opens into the terminal portion of the distribution pipe 15B upstream of the spray nozzle 30B and on the upper side of the ceiling 102. A check valve 58 is disposed in the conduit 51 downstream of the outlet 53 from the water storage cartridge 52 to prevent back flow through the conduit 51.

A gas conduit 57 establishes inert gas flow communication between the inert gas distribution line 15A, 15B associated with the water storage cartridge 52 and the interior volume 55 of the cartridge 52 through an inlet 59 at the upper portion of the aft end 54 of the cartridge 52. A back flow prevention means 28, such as a check valve or burst diaphragm, may be disposed in the gas conduit 57 to prevent back flow of water theretrough into gas conduit 57 when the inert gas distribution lines 15A, 15*b* are not pressurized, that is when inert gas is not flowing therethrough. As depicted in the exemplary embodiment illustrated in FIG. 4, a flow restriction orifice 25 may be inserted in the distribution pipe 15B at a location downstream of the opening of the gas conduit to the distribution pipe 15B and upstream of the opening of the water conduit 53 to the terminal portion of the distribution pipe 15B for the purpose of increasing the pressure drop experienced by the inert gas flowing therethrough thereby further increasing the pressure differential between the pressure of the inert gas admitted to the reservoir 55 within the water storage cylinder 50 and the gas pressure at the downstream location at which the water is emitted from the water storage cartridge 50 into distribution pipe 15B.

As noted previously, when a fire is detected within the protected space 100, the controller 18 sends a demand signal 17 to the flow control valve 16 causing the flow control valve 16 to open, thereby allowing pressurized inert gas to flow from the inert gas storage vessels 12 at a controlled rate through the main supply pipe 15 to and through the distribution pipes 15A and 15B and into the protected space 100 through the spray nozzles 30A and 30B. Additionally, a portion of the inert gas passing through the distribution pipes 15A and 15B passes through the respective gas conduit 57 associated with each spray nozzle assembly 20 to pressure the interior volume 55 of the water storage cartridge 52 thereby forcing water to flow from the water reservoir 50 through water conduit 51 to be introduced into the inert gas as previously described. As the inert gas is introduced into the interior volume 55 of the water storage cartridge at a gas pressure substantially higher than the gas pressure at the location at which the water is introduced into the inert gas flow, the water within the reservoir 50 will rapidly flow therefrom.

A rapid flow rate of water is desired in order to empty the water from the reservoir 50 within a relatively short period of time, typically one minute or less. To provide a relatively constant flow rate over the short period of time in which the reservoir 50 is to be emptied, a water flow orifice assembly 60 may be disposed in the water conduit 51 downstream of the outlet 53 from the water storage cartridge 52. The orifice is sized appropriately to provide a desired pressure drop sufficient to affect a relatively constant mass flow ratio of water mass flow rate through the water conduit 51 to inert gas mass flow rate. Due to the high pressure of the inert gas emitted into the interior volume within the water storage cartridge 52, without the orifice present to provide this pressure drop, the water flow through the water conduit 51 will decay over the time period required to empty the reservoir 50 from a relatively high flow rate initially to a relatively low rate near the end of the time period.

In conventional inert gas flooding fire suppression systems, the inert gas not only raises the heat capacity of the atmosphere in the protected space into which the inert gas is introduced, but also reduces the volumetric concentration of oxygen in the atmosphere within the protected space to a level less than 14%, which is generally accepted as a volumetric oxygen concentration that gives personnel within the protected space an adequate opportunity to evacuate the premises. In combination, the increase in heat capacity and reduction in oxygen concentration establishes a fire extinguishing atmosphere within the protected space. Thus, in buildings or other installations equipped with conventional inert gas systems that operate to totally flood the protected space with a fire extinguishing atmosphere, personnel within the protected space at the time of activation of the fire suppression system can safely remain within the protected space for only a short period of time and therefore must rapidly evacuate the protected space.

Figure 6:
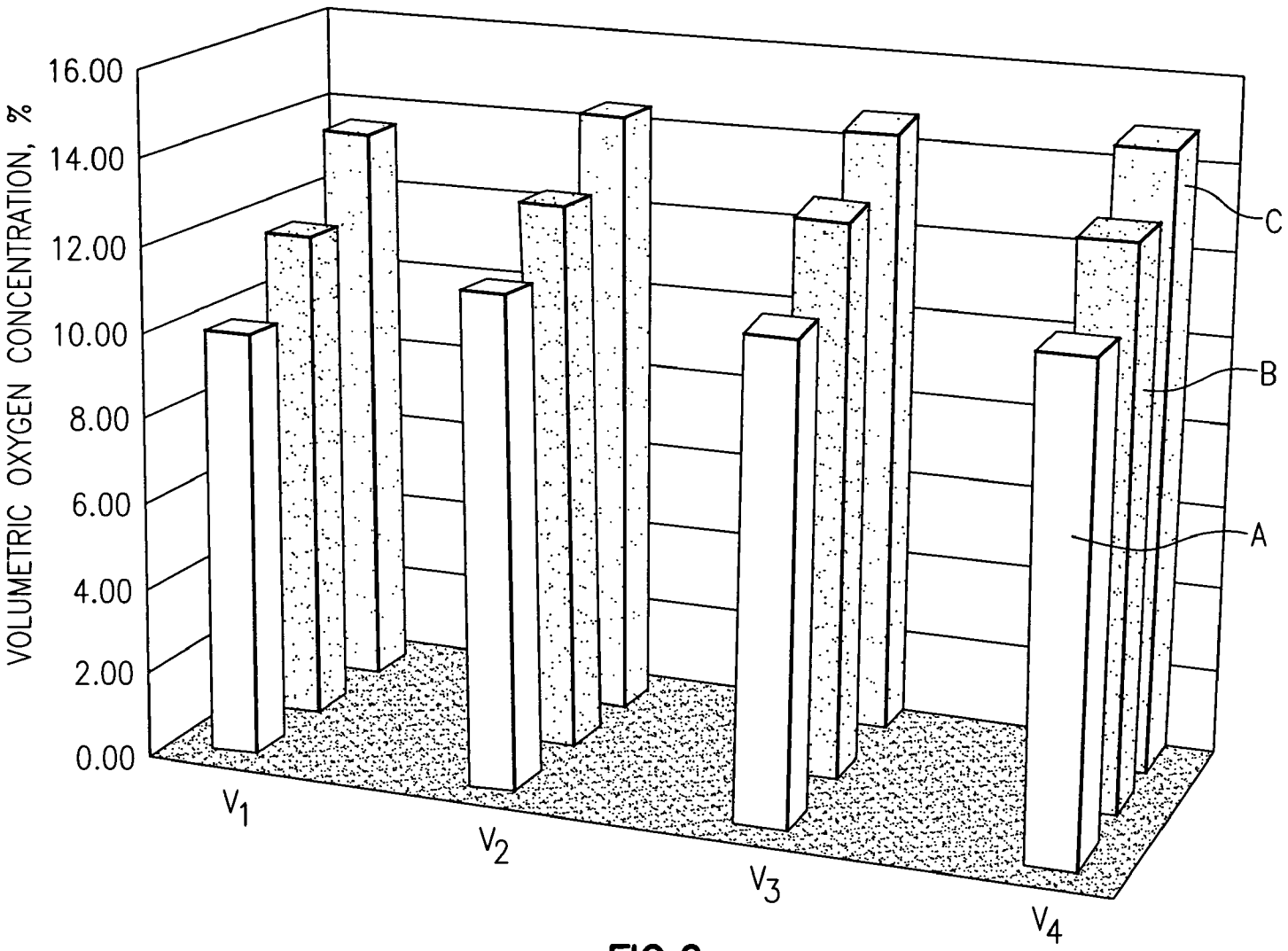
FIG. 6 is a bar graph illustrating the oxygen content of a fire extinguishing atmosphere for the hybrid inert gas fire suppression system of the invention in comparison to conventional Nitrogen and Argon/Nitrogen inert gas fire suppression systems.

Applicants have found that the admission of a limited amount of water into the inert gas flooding flow results in a hybrid inert gas fire suppression system that not only floods the protected space with an effective fire extinguishing atmosphere, but also provides a safer atmosphere for humans and animals within the protected space. Referring now to FIG. 6, a bar graph is presented that compares the volumetric oxygen concentration characteristically present in the resultant fire extinguishing atmosphere produced when rooms of various volumes are flooded via inert gas from a conventional pure inert gas fire suppression system employing a mixture of equal parts of a nitrogen gas and an argon gas, represented by bars A, a conventional pure inert gas fire suppression system employing a nitrogen gas, represented by bars B, and a hybrid inert gas fire suppression system that employs nitrogen gas with water augmentation in accord with the present invention, represented by bars C. As illustrated, the volumetric oxygen concentrations in the fire extinguishing atmosphere produced via the conventional inert gas fire suppression systems, represented by bars A and B, range from slightly less than 9% to about 12.5%.

However, the volumetric oxygen concentrations in the fire extinguishing atmosphere produced via the hybrid inert gas fire suppression system of the invention, represented by bars C, range from about 13% to about 14.5%. Further, for each defined volume, the volumetric oxygen concentration of the fire extinguishing atmosphere produced via the hybrid inert gas fire suppression system of the invention was about 2% higher than the volumetric oxygen concentration characteristic of a conventional pure nitrogen gas fire suppression system (bars B), and about 4% higher than the volumetric oxygen concentration characteristic of a conventional argon/nitrogen gas fire suppression system (bars A). With a higher volumetric oxygen concentration in the resultant fire extinguishing atmosphere, the hybrid inert gas fire suppression system of the invention is safer for humans and animals present in the protected space at the time of activation of the fire suppression system. The higher volumetric oxygen concentration within the resultant fire extinguishing atmosphere improves the conditions and lengthens the time conducive for emergency evacuation, thereby providing personnel within the protected space a better opportunity to safely evacuate the premises.

The added water augments the fire suppression capability of the inert gas by increasing the heat capacity of the resultant fire extinguishing atmosphere as compared to pure inert gas systems. This increase in heat capacity compensates for the lesser reduction in the volumetric oxygen concentration. Thus, the hybrid inert gas fire suppression system of the invention is capable of providing an effective flooding fire extinguishing atmosphere while providing a safer atmosphere for personnel occupying the protected space at the time of activation of the fire suppression system. Additionally, the amount of inert gas required in operation of the hybrid inert gas fire suppression system of the invention is reduced relative to the amount required in a similarly sized conventional inert gas system because the heat capacity of the fire extinguishing atmosphere has been augmented by the water introduced into the inert gas flow. As a result, the amount of inert gas that must be stored for use in connection with an installed inert gas system can be reduced.

The amount of water introduced into the inert gas should be limited. If an excessive amount of water is introduced into the inert gas, the inert gas flooding effect would be lost and the system would operate similar to conventional water streaming fire suppression systems. The amount of water introduced into the flow of inert gas should also be limited to ensure that all of the water is rapidly evaporated upon introduction into the protected space. For example, with the hybrid inert gas fire suppression system of the invention installed in a building for fire suppression within a room having a volume of about 100 cubic meters, to suppress a fire therein, between 4 and 15 liters of water would be introduced into a mass flow of about 30 kilograms of inert gas introduced into the room through a single spray nozzle.

Figure 7:
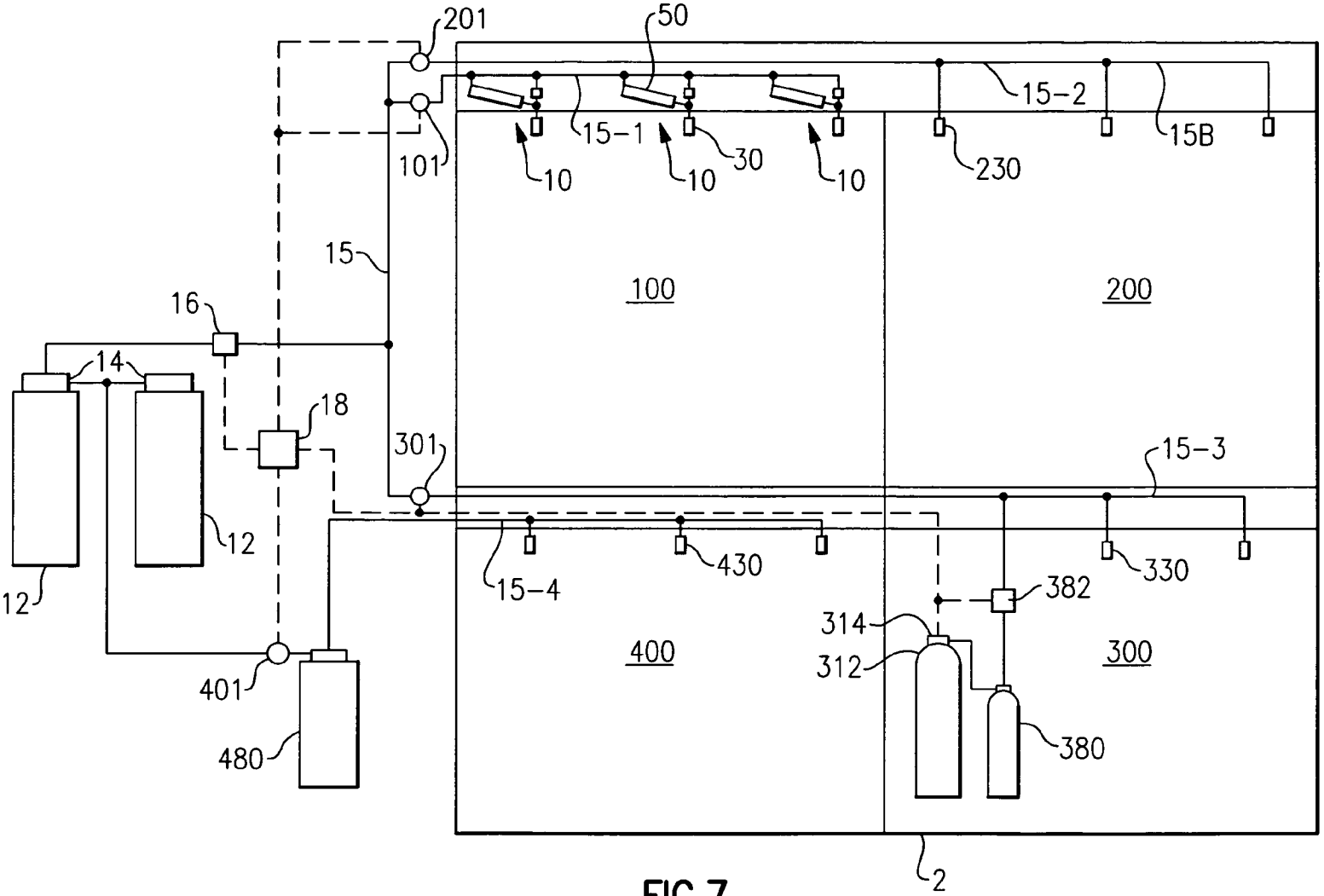
FIG. 7 is a schematic illustration of an exemplary embodiment of the hybrid inert gas fire suppression system of the invention installed in a building in conjunction with other types of conventional fire suppression systems.

It is to be understood that the hybrid inert gas flooding fire suppression system 10 may be installed in a building as the sole fire suppression system, or in combination with a conventional inert gas flooding fire suppression system, or in combination with a conventional centralized streaming fire suppression system, or in combination with a conventional localized streaming fire suppression system, or in combination with other conventional fire suppression systems, or in combination with any combination of two or more conventional fire suppression systems. For example, referring now to FIG. 7, there is depicted schematically a building 2 having four rooms, each of which is protected by a fire suppression system. Room 100 is protected by the hybrid inert gas flooding fire suppression system of the invention, room 200 is protected by a conventional inert gas flooding fire suppression system, room 300 is protected by a first type of conventional streaming fire suppression system, and room 400 is protected by a second type of conventional streaming fire suppression system.

As noted before, when activated the hybrid inert gas fire suppression system of the invention establishes a fire extinguishing atmosphere that has a higher oxygen content then would be establish through a conventional pure inert gas fire suppression systems. In large multi-purpose buildings, there are typically a variety of rooms serving different functions that need to be protected with a fire suppression system, including for example business offices, hotel quest rooms, conference rooms, libraries, computer rooms, electronic equipment rooms, telecommunication centers, food service kitchens, boiler rooms, among other spaces. To optimize fire suppression, more than one type of fire suspension system may be installed based upon the various rooms/spaces to be protected. The hybrid inert gas fire suppression system 10 is advantageously suited for installation in connection with protecting generally occupied rooms such as offices, retail shops, hotel guest rooms, conference rooms and the like. Conventional pure inert gas suppression systems are particularly suited for installation in rooms/spaces where water, chemical foams or fire suppressant residue could damage equipment, books or other or property, such as computer rooms, electronic equipment rooms, telecommunication centers, libraries and the like. Localized streaming fire suppression systems are advantageously suited for use in connection with rooms/spaces where a large amount of water or liquid chemical agent fire suppressant is typically needed for fire suppression and water/liquid damage is of lesser concern, such as kitchens, boiler rooms, and like spaces.

With respect to each room, if a fire is detected within that room, a central controller 18 activates the fire suppression system associated with that room. To suppress a fire in room 100, the controller 18 opens inert gas flow control valve 16 and also opens the shut-off valve 101 to allow pressurized inert gas to pass through pipe 15 and branch pipe 15-1 to and through the spray nozzles 30 to flood the protected space defined by room 100. A portion of the inert gas passing through the branch pipe 15-1 also pressures the cartridge 50 forcing the water stored therein into the inert gas flowing into the protected space defined by room 100. To suppress a fire in room 200, the controller 18 opens inert gas flow control valve 16 and also opens the shut-off valve 201 to allow pressurized inert gas to pass through pipe 15 and branch pipe 15-2 to and through the spray nozzles 230 to flood the protected space defined by room 100.

To suppress a fire in room 300, the controller 18 opens inert gas flow control valve 16 and also opens the shut-off valve 301 to allow pressurized inert gas to pass through pipe 15 and branch pipe 15-3 to and through the spray nozzles 330. Additionally, the controller opens water flow control valve 382 and opens propellant gas flow control valve 314 to permit propellant gas from storage tanks 312 to propel water or other liquid fire suppressant chemical from the local storage tank 380 into the inert gas flowing through pipe 15-3 to be introduced into the protected space defined within room 300 through the spray nozzles 330 as a mist of water or other liquid fire suppressant chemical. To suppress a fire in room 400, the controller 18 opens inert gas flow control valve 401 to permit the inert gas to propel the water or other liquid fire suppressant chemical from the central storage tank 480 through pipe 15-4 to be introduced into the protected space defined within room 400 through the spray nozzles 430 as a mist of water or other liquid fire suppressant chemical.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A hybrid fire suppression system comprising:

a supply of pressurized inert gas;

a pipe network connected in inert gas flow communication to said inert gas supply, said pipe network having a first terminus associated with a first protected space and a second terminus associated with a second protected space, the first protected space being separate from the second protected space;

a first inert gas nozzle in flow communication with said first terminus for introducing a flooding flow of inert gas only into the first protected space, the first inert gas nozzle protecting only the first protected space;

a second inert gas nozzle in flow communication with said second terminus for introducing a flooding flow of inert gas and a limited amount of water into the second protected space, the second inert gas nozzle protecting only the second protected space; and a water storage cartridge having an interior volume defining a water reservoir storing said limited amount of water in proximity to said second inert gas nozzle, said water reservoir in water flow communication with said second inert gas nozzle.

2. The hybrid fire suppression system as recited in claim 1 wherein said water storage cartridge comprises an elongated body extending along a longitudinal axis between an aft end and a forward end, the forward end of said body being disposed adjacent said second inert gas nozzle.

3. The hybrid fire suppression system as recited in claim 2 further comprising a gas flow conduit establishing flow communication between the supply of pressurized inert gas and the interior volume of said water storage cartridge, the gas conduit having an outlet opening to the interior volume of said water storage cartridge through the aft end of said water storage cartridge.

4. The hybrid fire suppression system as recited in claim 2 further comprising a water conduit establishing flow communication between the interior volume of said water storage cartridge and said second inert gas nozzle, the water conduit having an inlet opening to the interior volume of said water storage cartridge through a lower portion of the forward end of said water storage cartridge.

5. The hybrid fire suspension system as recited in claim 1 wherein said source of pressurized inert gas comprises a source of a pressurized, chemically non-reactive gas selected from the group including nitrogen gas, carbon dioxide gas, helium gas, argon gas, neon gas, and mixtures of two or more thereof.

6. The hybrid fire suppression system as recited in claim 1 further comprising:

a third nozzle in flow communication with a third terminus of said pipe network; and a source of pressurized water located remotely from said third nozzle, said water source holding a relatively large amount of water as compared to the limited amount of water stored in said water storage cartridge, said third nozzle for introducing into a third protected space a flow of inert gas having water from said remote water source entrained therein.

7. The hybrid fire suppression system as recited in claim 6 wherein the source of pressurized water is located within the space being protected by the third nozzle.

8. The hybrid fire suppression system as recited in claim 6 wherein the source of pressurized water is located remotely from the space being protected by the third nozzle.

9. The hybrid fire suppression system as recited in claim 1 wherein the first protected space is a first room and the second protected space is a second room isolated from the first room by a wall.

* * * * *